United States Patent [19]

Yoshimura et al.

[11] Patent Number: 4,978,468

[45] Date of Patent: Dec. 18, 1990

[54] TRACTION FLUID

[75] Inventors: Narihiko Yoshimura; Hirotaka Tomizawa; Yasuji Komatsu, all of Saitama, Japan

[73] Assignee: Toa Nenryo Kogyo, K. K., Tokyo, Japan

[21] Appl. No.: 299,308

[22] Filed: Jan. 19, 1989

Related U.S. Application Data

[63] Continuation of Ser. No. 98,915, Sep. 21, 1987, abandoned.

[51] Int. Cl.[5] ..... C10M 105/34

[52] U.S. Cl. ..... 252/79; 252/565; 252/57; 252/73

[58] Field of Search ..... 252/79, 73, 52 R, 56 S, 252/57; 560/1, 193

[56] References Cited

U.S. PATENT DOCUMENTS

| | | | |
|---|---|---|---|
| 2,016,392 | 10/1935 | Schneider | 560/1 |
| 2,807,638 | 9/1957 | Morris et al. | 560/1 |
| 3,133,021 | 5/1964 | Gisser et al. | 252/51.5 A |
| 3,440,894 | 4/1969 | Hammann et al. | 252/52 R |
| 3,595,797 | 7/1971 | Duling et al. | 252/73 |
| 3,608,385 | 9/1971 | Duling et al. | 252/73 |
| 3,803,037 | 4/1974 | Wygant | 252/32.7 E |
| 3,871,837 | 3/1975 | Bedaque et al. | 44/58 |
| 4,178,261 | 12/1979 | Dhein et al. | 252/57 |
| 4,292,187 | 9/1981 | Hentschel et al. | 252/49.5 |
| 4,343,652 | 8/1982 | Allart et al. | 106/21 |
| 4,464,277 | 8/1984 | Cousineau et al. | 252/565 |
| 4,499,000 | 2/1985 | Hentschel et al. | 252/73 |
| 4,514,190 | 4/1985 | Cousineau et al. | 44/70 |
| 4,519,932 | 5/1985 | Schnur et al. | 252/73 |
| 4,589,990 | 5/1986 | Zehler et al. | 252/565 |
| 4,606,833 | 8/1986 | Schuettenberg et al. | 252/49.3 |

FOREIGN PATENT DOCUMENTS

| | | |
|---|---|---|
| 786950 | 11/1957 | United Kingdom . |
| 1593113 | 7/1981 | United Kingdom . |

OTHER PUBLICATIONS

Corina, D. et al., J. Chromatogr. 260 (1), 51–62, 1983.

Acylation of Glycerol, Ismailov et al., 1971, No. 2, 49–54, (Russ.) from Ref. Zh., Khim, 1972, Abstr. No. 4Zh180.

*Primary Examiner*—Paul Lieberman

*Assistant Examiner*—Christine A. Skane

[57] ABSTRACT

A traction fluid comprising:

(i) an ester or its derivative represented by the formula:

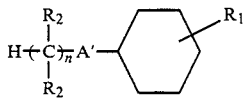

wherein A′ is an ester linkage of —COO— or —OOC—, n is an integer of from 1 to 14, $R_1$ is selected from hydrogen and $C_1$ to $C_8$ alkyl radicals, and $R_2$ is independently selected from hydrogen and $C_1$ to $C_3$ alkyl radicals; and (ii) from 0.1 to 95% by weight of a polymer selected from hydrocarbonic polymers and polyesters.

4 Claims, No Drawings

TRACTION FLUID

This is a continuation of application Ser. No. 098,915, filed Sept. 21, 1987, now abandoned.

FIELD OF THE INVENTION

This invention relates to an improved traction fluid. More particularly, the present invention is concerned with a traction fluid comprising an ester compound containing a cyclohexyl ring and a linear-chain hydrocarbon connected to each other through an ester linkage, and a hydrocarbonic polymer or esteric polymer as the base oil.

BACKGROUND OF THE INVENTION

The use of traction drive power transmissions which transmit power to a driven part through a traction drive mechanism in automobiles and industrial machinery has recently attracted attention, and in recent years there has been progress in research and development in this area. The traction drive mechanism is a power transmitting mechanism. Unlike conventional drive mechanisms it does not use any gears. This enables a reduction in vibration and noise as well as providing a smooth speed change in highspeed rotation. An important goal in the automobile industry is improvement in the fuel economy of automobiles. It has been suggested that if the traction drive is applied to the transmissions of automobiles in order to convert the transmission to the continuous variable-speed transmission fuel consumption can be reduced by at least 20% compared to conventional transmission systems. This is due to the fact that the drive can always be in the optimum fuel consumption region of an engine. Recent studies have resulted in the development of materials having high fatigue resistance and in a theoretical analysis of traction mechanisms. As regards the traction fluid the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is required to be comprised of a lubricating oil having a high traction coefficient. It is known that a traction fluid possessing a molecular structure having a naphthene ring exhibits a high performance. "Santotrack ®" manufactured by the Monsanto Chemical Company is a commercially available traction fluid. Japanese patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated ( α-methyl)styrene polymer, hydrindane compound or the like has a high traction coefficient. Further, Japanese patent Laid Open No. 191797/1984 discloses a traction fluid containing an ester compound having a naphthene ring. It discloses that an ester obtained by the hydrogenation of the aromatic nucleus of dicyclohexyl cyclohexanedicarboxylate or dicyclohexyl phthalate is preferred as the traction fluid.

As mentioned above, in recent years there has been progress in the development of continuous variable-speed transmissions in the automobile industry. The higher the traction coefficient of the traction fluid the larger the allowable transmission force in the same device. This contributes to a reduction in the size of the entire device with a corresponding reduction in exhaust gas emission. Therefore, there is a need for a fluid having a traction coefficient which is as high as possible. However, the use of a currently commercially available traction fluid exhibiting the highest performance of all such currently commercially available fluids in such a traction drive device provides an unsatisfactory performance in respect to the traction coefficient. Furthermore, such a traction fluid is rather costly. The traction fluid which has been proposed in Japanese patent Publication No 35763/1971 contains α-methylstyrene polymer or its analogue as a component and, therefore, is also unsatisfactory as regards its performance and cost.

The present inventors have made extensive and intensive studies with a view to developing a traction fluid which not only exhibits a high traction coefficient but is also economical. As a result the present inventors have found that the combination of a specific amount of a hydrocarbonic polymer or esteric polymer and an ester compound or its derivative in which a cyclohexyl ring is connected to a linear-chain hydrocarbon through an ester linkage can provide a high-performance and economical base oil fluid. The present invention is based on this finding.

SUMMARY OF THE INVENTION

The instant invention is directed to a traction fluid comprising:

(i) at least one ester compound or its derivative containing a cyclohexyl or alkyl substituted cyclohexyl group joined to a linear chain hydrocarbon group by an ester group; and (ii) at least one polymer selected from hydrocarbon polymers such as polyolefins and hydrogenated polyolefins and polyester polymers such as polyacrylates and polymethyacrylates.

DETAILED DESCRIPTION OF THE INVENTION

According to the present invention there is provided a traction fluid comprising (i) an ester or its derivative represented by the general formula

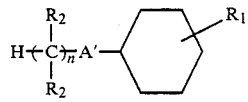

and (ii) from 0.1 to 95% by weight of a hydrocarbonic polymer or esteric polymer, wherein A' is an ester linkage of —COO— or —OOC—, n is an integer of 1 to 14, $R_1$ is a member selected from among a hydrogen atom and alkyl groups having to 8 carbon atoms, and $R_2$s are the same or different and are a member selected from among a hydrogen atom and alkyl groups having 1 to 3 carbon atoms.

A first object of the present invention is to provide a high-performance traction fluid having a high traction coefficient. A second object of the present invention is to provide a traction fluid which is not only economical but also readily available and easily applicable to transmissions. The traction fluid of the present invention comprises a base oil comprised of two components, i.e., component A comprised of an ester or its derivative and a specific amount of component B comprised of a hydrocarbonic polymer or esteric polymer.

The component A of the present invention is an ester compound or its derivative in which a cyclohexyl ring is connected to a linear-chain hydrocarbon through an ester linkage and has the above-mentioned structural formula. A' of the ester linkage is —COO— or —OCC—, and the number, n, of the carbon atoms in the hydrocarbon skeleton is 1 to 14, preferably 2 to 10. When n is zero, the traction coefficient is low while when n is 15 or more the viscosity is unfavorably high. This ester or derivative thereof has a viscosity of 3 to 150 cst, preferably 4 to 120 cst at 40° C., and 1 to 20 cst, preferably 1 to 16 cst at 100° C. Examples of the derivative of the ester include its amination product, halogenation product and ether compound.

The esters can be prepared by any of the following methods. The first method comprises an esterification react ion of a monohydric alcohol with a cyclohexanecarboxylic acid compound. The monohydric alcohol has 1 to 14 carbon atoms, preferably 2 to 10 carbon atoms, in its main chain. Specifically, examples of the monohydric alcohol include ethanol, propanol, 2-propanol, butanol, 2-methyl-2propanol, 3,3,5-trimethyl-1-hexanol, and 3,3,5,5-tetramethyl, Examples of the cyclohexanecarboxylic acid compound include, besides cyclohexanecarboxylic acid, those having an alkyl group with 1 to 8 carbon atoms, e.g., methylcyclohexanecarboxylic acid, ethylcyclohexanecarboxylic acid, etc. Cyclohexanecarboxylic acid is particularly preferred. The esterification reaction is conducted in the presence of an excess amount of the alcohol or acid. When the esterification is conducted under excess acid conditions 1 mol of the alcohol compound is reacted with 1 to 2 mol (particularly preferably 1.2 to 1.8 mol) of the acid. The reaction temperature is about 150° to 250° C., preferably 170° to 230° C., and the reaction time is 10 to 40 hr, preferably 15 to 25 hr. Although the esterification reaction may be conducted under either elevated or reduced pressures, it is preferred that the reaction is conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds water formed during the reaction evaporates. The reaction is terminated when an equimolar amount, with respect to the alcohol, of the water has evaporated. The excess acid is neutralized with an aqueous alkaline solution and removed by washing with water. When an acid which is difficult to extract with an alkali washing is used the reaction is conducted using equimolar amounts of the acid and the alcohol in the presence of a catalyst. Examples of the catalyst include phosphoric acid, p-toluenesulfonic acid and sulfuric acid. The most preferred catalyst is phosphoric acid, because it enhances the reaction rate and increases the yield of the ester. The reaction product is finally distilled under reduced pressure to remove water and the solvent, thereby obtaining the ester compound of the present invention.

When the esterification reaction is conducted under excess alcohol conditions 1 mol of cyclohexanecarboxylic acid is reacted with 1 to 2 mol (particularly preferably 1.2 to 1.8 mol) of the alcohol. The reaction temperature is about 150° to 250° C., preferably 170° to 230° C., and the reaction time is 10 to 40 hr, preferably 15 to 25 hr. Although the esterification reaction may be conducted under either elevated or reduced pressures, it is preferred that the reaction is conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds water which has been formed during the reaction evaporates. The reaction is terminated when an equimolar amount, with respect to the alcohol, of the water has evaporated. Examples of the catalysts include phosphoric acid, p-toluenesulfonic acid and sulfuric acid. The most preferred catalyst is phosphoric acid because it enhances the reaction rate and increases the yield of the ester. After termination of the reaction the reaction product is neutralized with an aqueous alkaline solution and is washed with water to remove the unreacted acid and catalyst. The reaction product is finally distilled under reduced pressure to remove water and the solvent, thereby obtaining the ester compound of the present invention.

The second method of producing the component A of the present invention comprises esterification of a cyclohexanol compounds with a dicarboxylic acid having 2 to 15 carbon atoms in its main chain. Examples of the cyclohexanol compounds include, besides cyclohexanol, those having an alkyl group with 1 to 8 carbon atoms, e.g., methylcyclohexanol and tertbutylcyclohexanol. Cyclohexanol is particularly preferred. The carboxylic acid includes one having 2 to 15 carbon atoms in its main chain, preferably one having 3 to carbon atoms in its main chain. Examples of the carboxylic acids include acetic acid, propionic acid, butyric acid, lauric acid, trimethylhexanoic acid, and tetramethylhexanoic acid. The esterification reaction is conducted in the presence of an excess amount of the acid or alcohol. When the esterification reaction is conducted under excess acid conditions 1 mol of a cyclohexanol compound is reacted with 1 to 2 mol (particularly preferably 1.2 to 1.8 mol) of the acid. The reaction temperature is about 150° to 250° C., preferably 170° to 230° C., and the reaction time is 10 to 40 hr, preferably 15 to 25 hr.

Although this esterification reaction may be conducted under either elevated or reduced pressures, it is preferred that the reaction be conducted at atmospheric pressure from the standpoint of ease of reaction operation. Phosphoric acid, p-toluenesulfonic acid or sulfuric acid is used as the catalyst. The most preferred catalyst is phosphoric acid because it enhances the reaction rate and increases the yield of the ester. An alkylbenzene such as xylene or toluene can be added in a suitable amount as a solvent. The addition of the solvent enables the reaction temperature to be easily controlled. As the reaction proceeds water which has been formed during the reaction evaporates. The reaction is terminated when an equimolar amount, with respect to the alcohol, of the water has evaporated. The reaction product is finally distilled under reduced pressure to remove the water and solvent thereby obtaining the ester compound of the present invention.

When the esterification reaction is conducted under excess alcohol conditions mol of the carboxylic acid is reacted with 1 to 2 mol (particularly preferably 1.2 to 1.8 mol) of the alcohol. The reaction temperature is about 150° to 250° C., preferably 170° to 230° C., and the reaction time is 10 to 40 hr, preferably 15 to 25 hr. Although the esterification reaction may be conducted under either elevated or reduced pressures, it is preferred that the reaction is conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds, water which has been formed during the reaction evaporates. The reaction is terminated when an equimolar amount, with respect to the carboxylic acid, of the water has evaporated. Examples of the catalyst include phosphoric acid, p-toluenesulfonic acid and sulfuric acid. The most preferred catalyst is phosphoric acid because it enhances the reaction rate and increases the yield of the ester. After termination of the reaction the reaction product is neutralized with an aqueous alkaline solution and is then washed with water to remove the catalyst. The reaction product is finally distilled under reduced pressure to remove the water, solvent and excess alcohol, thereby obtaining the ester compound of the present invention.

With respect to component B the hydrocarbonic (hydrocarbon) polymer is a polyolefin, a hydrocarbonic polymeric compound having a naphthene ring or an alkylstyrene polymer, while the esteric polymer (polyester) is a polymer of an ester compound having a side chain of an alkyl group and/or cyclohexyl ring. Examples of the polyolefin include a poly-α-olefin, an olefin copolymer, a polymer obtained by saturating the unsaturated bonds of the above polymer with hydrogen, and a modified polymer obtained by modifying the above polymer with a small amount of a modifier. Examples of the modifier include alkylcarboxylic acids, alcohols, and amines. Among the above-mentioned polymers a poly-α-olefin is particularly preferred.

The poly-α-olefin which is a preferred component B has a either a quaternary carbon atom or a tertiary carbon atom in its main chain and is a polymer of an α-olefin having 3 to 5 carbon atoms or the hydrogenation product thereof. Examples of the poly-α-olefin include polypropylene, polybutene, polyisobutylene and polypentene and the hydrogenation products thereof. Particularly preferred are polybutene and polyisobutylene and the hydrogenation products thereof. The polyisobutylene is represented by the following structural formula:

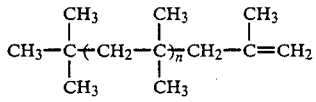

The hydrogenation product of the polyisobutylene is represented by the following structural formula:

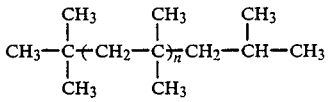

In the above-mentioned formulae, the degree of polymerization, n, is 6 to 200.

Although the polybutene and polyisobutylene may also be produced by commercially available ones, they may also be produced by conventional polymerization methods. The hydrogenation product thereof is produced by reacting polyisobutylene or the like in the presence of hydrogen. The molecular weight of the poly-α-olefin is preferably in the range of 500 to 10,000, more preferably in the range of 900 to 5,000. The molecular weight can be adjusted by suitable methods such as decomposition of a poly-α-olefin having a high molecular weight and mixing with poly-αolefins having different molecular weights. The olefin copolymer (OCP) can be obtained by polymerization of two or more olefins selected from among ethylene, propylene, butene, pentene, and styrene. OCP has such a structure that the olefins are irregularly linked with each other as opposed to a poly-α-olefin, such as polybutene, which has a regular gem-dialkyl structure.

Examples of the esteric polymer useful as component B include polymethacrylate or its derivative represented by the general formula:

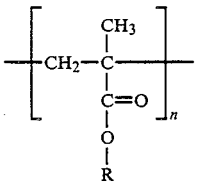

wherein $R^3$ is a hydrocarbon group having 1 to 18 carbon atoms and n' is an integer of 100 to 5,000, and polyacrylate or its derivative represented by the following formula:

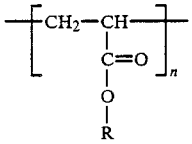

wherein $R^3$ is a hydrocarbon group having 1 to 18 carbon atoms and n' is an integer of 100 to 5,000. A preferred esteric polymer is polycyclohexyl acrylate or polycyclohexyl methacrylate having the above general formula in which $R^3$ is a cyclohexyl ring having 6 to 12 carbon atoms and n' is an integer of 200 to 250.

Component A in the present invention, e.g., an ester of 3,5,5-trimethylhexanoic acid with cyclohexanol, exhibits a traction coefficient of 0.080 to 0.090, while component B, e.g., polybutene, exhibits a traction coefficient of 0.075 to 0.085.

Any one of components A and B of the present invention has a lower traction coefficient than those of commercially available traction fluids. Therefore, they can not exhibit a high performance if they are used singly or individually in a traction drive device. However, an excellent traction fluid can be obtained by blending component A with 0.1 to 95% by weight, particularly preferably 10 to 70% by weight, of component B which is comprised of a hydrocarbonic polymer or esteric polymer. Specifically, a hydrocarbon group such as an alkyl group of component B cooperates with the cyclohexyl ring in component A to exhibit a synergistic effect (in respect to improvement of traction coefficient). Further, since component B is inexpensive and exhibits excellent viscosity characteristics, a traction fluid exhibiting enhanced traction coefficient can be economically obtained by blending the component A with 0.1 to 95% by weight of the component B.

Various additives may also be added to the traction fluid of the present invention depending on its applications. Specifically, when the traction device undergoes a high temperature and a large load at least one additive selected from among an antioxidant, a wear inhibitor and a corrosion inhibitor may be added in an amount of 0.01 to 5% by weight.

The term "traction fluid" as used in the present invention is intended to mean a fluid for use in devices which transmit a rotational torque through spot contact or line contact, or for use in transmissions having a similar structure. The traction fluid of the present invention exhibits a traction coefficient higher than those of conventionally known fluids, i.e., exhibits a traction coefficient 1 to 10% higher than those of the conventional fluids, although the value varies depending on the viscosity. Therefore, the traction fluid of the present invention can be advantageously used for relatively low power drive transmissions including internal combustion engines of small passenger cars, spinning machines and food processing machines, as well as for large power drive transmissions such as industrial machines, etc.

The traction fluid of the present invention exhibits a remarkably superior traction coefficient compared to conventional fluids. The reason why the traction fluid of the present invention exhibits a high traction coefficient is not yet fully understood. However, basically, the reason is believed to reside in the unique molecular structure of the traction fluid of the present invention.

The component A of the traction fluid of the present invention comprises an ester having a cyclohexyl ring in its molecule. The ester linkages bring about an interdipolar force between the molecules. It is believed that the interdipolar force serves to bring the fluid into a stable glassy state under high load conditions, thereby increasing the shearing force. Further, component B of the traction fluid of the present invention has a hydrocarbon group such as an alkyl group. Therefore, when the traction device is under high load conditions the cyclohexyl ring in the component A is firmly engaged, like gears, with the alkyl group in component B, while when the device is released from the load this engagement is quickly broken thereby causing fluidization.

The following Examples are provided for illustrative purposes only and are not to be construed as limiting the invention described herein.

EXAMPLES 1-18

Ester $A_1$ according to the present invention was synthesized by the following method. First, 150.2 g of cyclohexanol and 158.2 g of 3,5,5-trimethylhexanoic acid (wherein the mole ratio of the alcohol to the acid was 1.5:1) were charged into a reactor, and 1 weight percent phosphoric acid was added. Then the reactor was heated to 180° C. and the contents of the reactor were allowed to react at a temperature in the range of 170° C. to 200° C. under atmospheric pressure. The heating was stopped at a point when the water generated during the reaction amounted to the same number of moles as the above acid.

The reaction mixture was washed with an alkaline solution to remove unreacted compounds, i.e., cyclohexanol and phosphoric acid, from a mixture of a reaction product, i.e., an ester of cyclohexanol with trimethylhexanoic acid, the unreacted compounds and phosphoric acid, followed by vacuum distillation, thereby isolating a pure diester $A_1$.

In the same manner described above the other esters $A_2$ and $A_3$ of the present invention were synthesized using the following materials:

$A_2$ . . . 3,5,5-trimethyl-1-hexanol and cyclohexane carboxylic acid (no catalyst was used due to the surplus of acid.)

$A_3$ . . . Lauric acid and cyclohexanol (Phosphoric acid catalyst was used.)

Next, the ester thus produced was blended with polybutene $B_1$ having average molecular weight of 900 to 2350, an olefin copolymer (OCP) $B_2$* or an esteric polymer $B_3$**, followed by measurement of the traction coefficient. The measurement conditions of traction coefficient were as follows.

* A copolymer of ethylene with propylene having an average molecular weight of $32.3 \times 10^4$

** A polycyclohexylacrylate having an average molecular weight of $5 \times 10^4$ Measuring equipment: Soda-type four roller traction test machine.

Testing conditions: a fluid temperature of 20° C.; a roller temperature of 30° C.; a mean Hertzian pressure of 1.2 GPa; a rolling velocity of 3.6 m/s; and a percent slipping ration of 3.0%.

The traction fluid obtained by this invention was found to be remarkably superior in its traction performance to the conventional fluids, as shown in Table 1.

COMPARATIVE EXAMPLES 1-5

Traction fluids prepared from $A_1$ to $A_3$ components alone and $B_1$ component alone, and a commercially available traction fluid (Santotrack ®) were used as the comparative samples. Traction coefficients of these comparative samples were measured under the same conditions as described hereinafore.

The results are shown in Table 1. As can be seen from Table 1 all the comparative samples exhibited traction coefficients 1 to 10% smaller than that of the traction fluid of the present invention.

TABLE 1

| | A | | B | | | Viscosity (cst) | | Viscosity | Traction |
|---|---|---|---|---|---|---|---|---|---|
| | Loadings wt % | | M.W. | | Loadings wt % | 40° C. | 100° C. | index | coefficient |
| Example | | | | | | | | | |
| 1 | $A_1$ | 75 | $B_1$ | 900 | 25 | 16.1 | 4.04 | 157 | 0.095 |
| 2 | | 66 | | " | 34 | 25.4 | 5.73 | 178 | 0.096 |
| 3 | | 82 | | 1260 | 18 | 13.0 | 3.82 | 209 | 0.091 |
| 4 | | 74 | | " | 26 | 23.8 | 5.39 | 173 | 0.095 |
| 5 | | 66 | | " | 34 | 39.7 | 8.19 | 187 | 0.100 |
| 6 | | 58 | | " | 42 | 101.0 | 12.98 | 125 | 0.096 |
| 7 | | 88 | | 2350 | 12 | 12.8 | 4.05 | 249 | 0.093 |
| 8 | | 70 | | " | 30 | 91.9 | 14.38 | 162 | 0.100 |
| 9 | $A_2$ | 57 | $B_1$ | 900 | 43 | 45.9 | 8.59 | 168 | 0.090 |
| 10 | | 70 | | 1260 | 30 | 39.1 | 7.18 | 149 | 0.089 |
| 11 | | 62 | | " | 38 | 75.1 | 10.84 | 132 | 0.089 |
| 12 | | 74 | | 2350 | 26 | 50.3 | 11.30 | 226 | 0.090 |

TABLE 1-continued

| | A | | B | | | Viscosity (cst) | | Viscosity | Traction |
|---|---|---|---|---|---|---|---|---|---|
| | Loadings wt % | | M.W. | | Loadings wt % | 40° C. | 100° C. | index | coefficient |
| 13 | $A_3$ | | $B_1$ | 1260 | 34 | 64.2 | 9.31 | 123 | 0.091 |
| 14 | $A_1$ | | $B_2$ | 323000 | 5 | 10.0 | 3.13 | 200 | 0.087 |
| 15 | $A_2$ | | " | " | 5 | 9.8 | 3.27 | 238 | 0.078 |
| 16 | $A_3$ | | " | " | 5 | 16.2 | 4.45 | 206 | 0.083 |
| 17 | $A_1$ | | $B_3$ | 50000 | 5 | 11.4 | 3.52 | 215 | 0.092 |
| 18 | $A_2$ | | " | " | 10 | 12.3 | 4.01 | 264 | 0.089 |
| Comp. Ex. | | | | | | | | | |
| 1 | $A_1$ | 100 | — | | 0 | 5.0 | 1.66 | 85 | 0.084 |
| 2 | $A_2$ | " | — | | 0 | 5.1 | 1.77 | 121 | 0.076 |
| 3 | $A_3$ | " | — | | 0 | 8.5 | 2.31 | 78 | 0.080 |
| 4 | — | | $B_1$ | 900 | 100 | 11600 | 240 | 108 | 0.081 |
| 5 | Santotrack ® | | — | | 0 | 13.8 | 2.99 | 46 | 0.087 |

The traction fluid of the present invention comprises a compound (component A) in which a cyclohexyl ring is connected to a linear-chain hydrocarbon through an ester linkage, and a specific amount of a hydrocarbonic polymer or esteric polymer. Such a traction fluid not only exhibits an extremely high traction coefficient but is also inexpensive and has excellent viscosity characteristics.

Therefore, the use of the traction fluid of the present invention in a power transmission, particularly a traction drive device, results in a remarkable increase in shearing force under a high load. This enables the reduction in size of the device as well as reduced costs thereof.

We claim:

1. A traction fluid comprising:

(i) ester or its derivative represented by the formula

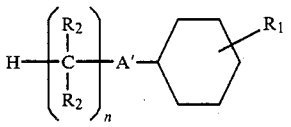

wherein A′ is an ester linkage of —COO— or —OOC—, n is an integer of from 1 to 14, $R_1$ is selected from hydrogen and alkyl radicals containing from 1 to 8 carbon atoms, and $R_2$ is independently selected from hydrogen and alkyl radicals containing from 1 to 3 carbon atoms; and (ii) from 0.1 to 95% by weight of at least one polymer selected from the group consisting of cyclohexyl acrylate polymer and cyclohexyl methacrylate polymer.

2. The fluid of claim 1 which contains from 10 to 70% by weight of (ii).

3. The fluid of claim 1 wherein $R_2$ is independently selected from hydrogen or a methyl radical.

4. The fluid of claim 3 wherein $R_1$ is selected from hydrogen and alkyl radicals containing from 1 to 4 carbons.

* * * * *